US005447417A

United States Patent [19]

Kuhl et al.

[11] Patent Number: 5,447,417

[45] Date of Patent: Sep. 5, 1995

[54] SELF-ADJUSTING PUMP HEAD AND SAFETY MANIFOLD CARTRIDGE FOR A PERISTALTIC PUMP

[75] Inventors: Peter J. Kuhl, Jackson Heights, N.Y.; Joseph N. Logan, Trumbull, Conn.

[73] Assignee: Valleylab Inc., Boulder, Colo.

[21] Appl. No.: 114,569

[22] Filed: Aug. 31, 1993

[51] Int. Cl.[6] ..... F04B 43/08

[52] U.S. Cl. ..... 417/477.11

[58] Field of Search ..... 417/477.1, 477.9, 477.11, 417/474, 476; 604/153

[56] References Cited

U.S. PATENT DOCUMENTS

| | | | |
|---|---|---|---|
| Re. 30,627 | 5/1981 | Bagshawe et al. | 23/230 |
| Re. 31,374 | 9/1983 | Dell | 137/565 |
| D. 264,134 | 4/1982 | Xanthopoulos | D24/99 |
| 1,998,337 | 4/1935 | Spiess | 270/68 |
| 2,434,802 | 1/1948 | Jacobs | 103/149 |
| 3,137,241 | 6/1964 | Isreeli | 103/149 |
| 3,167,397 | 1/1965 | Skeggs et al. | 23/253 |
| 3,227,091 | 1/1966 | Isreeli et al. | 103/149 |
| 3,353,491 | 11/1967 | Bastian | 103/149 |
| 3,617,222 | 11/1971 | Matte | 23/230 |
| 3,737,251 | 6/1973 | Berman et al. | 417/12 |
| 3,778,195 | 12/1973 | Bamberg | 417/474 |
| 3,829,249 | 8/1974 | Pursley | 417/411 |
| 3,876,340 | 4/1975 | Thomas | 417/475 |
| 3,918,854 | 11/1975 | Catarious | 417/477 |
| 3,923,463 | 12/1975 | Bagshane et al. | 23/253 |
| 3,990,444 | 11/1976 | Vial | 128/214 |
| 3,994,687 | 11/1976 | Engelbrecht | 23/230 |
| 4,025,241 | 5/1977 | Clemens | 417/477 |
| 4,034,700 | 7/1977 | Bassett et al. | 118/2 |
| 4,180,074 | 12/1979 | Murray et al. | 128/276 |
| 4,184,510 | 1/1980 | Murray et al. | 210/800 |
| 4,189,286 | 2/1980 | Murry et al. | 417/477 |
| 4,210,138 | 7/1980 | Jess et al. | 128/214 |
| 4,214,530 | 8/1980 | Kopp et al. | 422/69 |
| 4,218,197 | 8/1980 | Meyer et al. | 417/442 |
| 4,256,442 | 3/1981 | Lamadrid et al. | 417/477 |
| 4,288,205 | 9/1981 | Henk | 417/477 |
| 4,373,525 | 2/1983 | Kobayashi | 128/214 |
| 4,473,342 | 9/1984 | Iles | 417/360 |
| 4,482,347 | 11/1984 | Borsanyi | 604/153 |
| 4,500,266 | 2/1985 | Cummins | 417/474 |
| 4,519,754 | 5/1985 | Minick | 417/477 |
| 4,537,561 | 8/1985 | Xanthopoulos | 417/63 |
| 4,544,336 | 10/1985 | Faeser | 417/412 |
| 4,585,399 | 4/1986 | Baier | 417/477 |
| 4,599,055 | 7/1986 | Dykstra | 417/477 |

(List continued on next page.)

*Primary Examiner*—Richard A. Bertsch
*Assistant Examiner*—Peter G. Korytnyk
*Attorney, Agent, or Firm*—Peter C. Richardson; Lawrence C. Akers; Aaron Passman

[57] ABSTRACT

An actuator for a self-adjusting pump head assembly has a variable position pump shoe slidably attached to a base. The assembly pumps liquids through a tube in a peristaltic pump, including a translator of rotational motion into linear motion and a crank for automatically compensating for the manufacturing tolerances of the tube in the pump pivotally attached to the translator and the shoe. The crank for automatically compensating has a linkage or pair of links, carrying a helical compression spring, pivotally anchored to the translator and the shoe. The peristaltic pump includes a self-adjusting pump head, including a variable position pump shoe slidably attached to a base and a control for positioning, locking and applying a continuous reaction force on the shoe to compress the tube between the shoe and at least one roller located on the periphery of a mandrel. Thus the control further has the translator of rotational motion into linear motion, and the crank for automatically compensating for the manufacturing tolerances of the tube introduced into the pump, pivotally attached to the translator and the shoe. Alternatively the pump has a disposable manifold safety cartridge, removably attached to the base, to which ends of the tube attach. The cartridge has an asymmetrical tie bar keyed onto the base to insure that the cartridge is oriented in an acceptable manner and that the tube will be properly installed on the pump.

21 Claims, 10 Drawing Sheets

U.S. PATENT DOCUMENTS

| | | | |
|---|---|---|---|
| 4,604,038 | 8/1986 | Belew | 417/475 |
| 4,648,812 | 3/1987 | Kobayashi et al. | 417/477 |
| 4,673,334 | 6/1987 | Allington et al. | 417/53 |
| 4,705,464 | 11/1987 | Arimond | 417/477 |
| 4,708,604 | 11/1987 | Kidera | 417/477 |
| 4,725,205 | 2/1988 | Cannon et al. | 417/363 |
| 4,728,265 | 3/1988 | Cannon | 417/363 |
| 4,798,580 | 1/1989 | De Meo et al. | 604/30 |
| 4,813,855 | 3/1989 | Leveen et al. | 417/477 |
| 4,824,339 | 4/1989 | Bainbridge et al. | 417/477 |
| 4,861,242 | 8/1989 | Finsterwald et al. | 417/477 |
| 4,886,431 | 12/1989 | Soderquist et al. | 417/477 |
| 4,889,812 | 12/1989 | Guinn et al. | 435/289 |
| 4,925,376 | 5/1990 | Kahler | 417/477 |
| 4,954,046 | 9/1990 | Irvin et al. | 417/53 |
| 5,011,378 | 4/1991 | Brown et al. | 417/360 |
| 5,024,586 | 6/1991 | Meiri | 417/477 |
| 5,049,047 | 9/1991 | Polaschegg et al. | 417/474 |
| 5,082,429 | 1/1992 | Soderquist et al. | 417/477 |
| 5,110,270 | 5/1992 | Morrick | 417/477 |
| 5,125,891 | 6/1992 | Hossain et al. | 604/34 |
| 5,131,816 | 7/1992 | Brown et al. | 417/2 |
| 5,173,038 | 12/1992 | Hopfensperger et al. | 417/476 |
| 5,230,614 | 7/1993 | Zanger et al. | 417/477.9 |

SELF-ADJUSTING PUMP HEAD AND SAFETY MANIFOLD CARTRIDGE FOR A PERISTALTIC PUMP

FIELD OF THE INVENTION

The invention relates generally to peristaltic pumps and components thereof. More particularly, the invention relates to peristaltic pumps that include a self adjusting pump head, means for automatically compensating for manufacturing tolerances of tubes introduced into the pump, and means for insuring any tube introduced into the pump is properly installed.

The pump contemplated by the invention has a self-adjusting pump head that includes a variable position pump shoe slidably attached to a base, and a disposable safety manifold cartridge, removably attached to the base, to which the ends of a tube are attached.

The tube may be introduced into the pump when the pump head is in a first ("open") position. When the pump head is in a second ("closed") position, the tube is compressed between the aforementioned shoe and a rotatable mandrel having at least one roller located on its periphery. As the mandrel rotates, fluids within the tube are subject to the pumping action that occurs when the tube is periodically occluded by the roller(s) squeezing the tube against the shoe.

Pumps of the type described hereinabove have many applications including recognized utility in the medical field. For example, peristaltic pumps are used in ultrasonic surgical aspirators.

The pump contemplated by the invention assures a consistent pumping action which affects fluid delivery rate. Fluid delivery rate is an extremely important consideration in medical applications, particularly those applications involving the pumping of small volumes of fluid.

According to the invention, the consistent pumping action is achieved by utilizing a single control for positioning, locking and applying a continuous reaction force on the adjustable (variable position) pump shoe used to compress the tube introduced into the pump.

The control automatically compensates for manufacturing tolerances in tube wall and shoe construction by using actuating means that, in a preferred embodiment of the invention, includes a control knob (for translating rotational motion into linear motion), in combination with cranking means, pivotally attached to the knob and the adjustable shoe, that includes a linkage or pair of links (also referred to herein as "spring plates") carrying a helical compression spring.

The disposable safety manifold cartridge contemplated by the invention, is designed to cooperate with at least one "key" ridge formed on the aforementioned base. This keying process insures that a tube introduced into the pump will be properly installed since the key ridge(s), according to the invention, will interfere with cartridge installation if the cartridge is not oriented in a predefined acceptable manner. The disposable safety manifold cartridge contemplated by the invention is further used to make introduction of the tube into the pump a user friendly, one handed, operation.

When utilizing both the control and safety manifold cartridge contemplated by the invention the resulting peristaltic pump is both easy and safe to use, and exhibits other benefits, such as extending tube life, preventing tube spilling and the risk of contaminating fluid lines, etc.

BACKGROUND OF THE DISCLOSURE

Many surgical devices rely on positive displacement pumps to deliver or remove irrigating fluid during an operation. These devices are well known in the art and take many forms.

Typically, these "peristaltic" pumps employ a fixed position pump head, a rotating mandrel with one or more rollers spaced around its periphery, and a cavity or shoe which compresses the tubing sufficiently to allow a pumping action of the fluid. Peristaltic pumps have been used as surgical aspirators to provide suction of irrigating fluid and tissue from surgical sites; and to deliver irrigation fluid to provide lubrication for evacuated material, cooling for surgical probes, and to provide a safety barrier between the probe and surrounding tissue.

The known devices used for such purposes have recognized limitations and deficiencies. For example, volumetric fluid delivery is often inconsistent from operation to operation when using pumps having a fixed gap between the aforementioned mandrel and shoe. The fixed gap yields variations in tubing occlusion and thus variations in pump efficiency and rate of fluid delivery. As indicated hereinabove, this can be particularly significant when pumping small volumes of fluid in medical applications.

The known pumps are also sensitive to manufacturing tolerances of the tubing (outer diameter, inner diameter, wall thickness and/or durometer), as well as to variations in machined part or assembly tolerances. These factors all have the potential for producing undesirable variations in pump performance making it difficult to maintain the calibration of these devices.

Problems also arise in working with the tubing used in the known pumps. In particular, it is often awkward and confusing to insert the tubing into the pump head of known devices. In many pump arrangements no mechanical advantage exists when closing the pump shoe to compress the tubing making for a difficult operation that could result in a crimped tube condition or require the use of two hands to pull and stretch the pump tubing before latching the shoe closed.

The potential also exists for inserting the tube in such a way as to cause fluid flow in the wrong direction, and furthermore, tubing has the propensity to "walk" which in many known pumps has the potential for causing a tubing jam, or even a separation or rip in the fluid line.

Further yet, the fixed occlusion rate of known peristaltic pumps requires that the wall thickness of the compressible tube inserted into the pump be precise and consistent. Manufacturing tolerances for the tubes and pump components (like the aforementioned shoe), are not well tolerated without having an effect on pump performance.

Tube life is also affected by pump performance and can be adversely affected by devices which do not compensate for manufacturing tolerances in the tubing, pump shoe and other components which cooperate to produce the desired pumping action.

Many attempts have been made to address the aforementioned limitations and deficiencies of peristaltic pumps that utilize a fixed position pump head.

Peristaltic pumps have been devised that utilize an adjustable shoe as part of self adjusting pump head; rather then a fixed position pump head; actuating means have been developed that are coupled to an adjustable shoe for positioning/forward biasing the shoe to compress a tube; and means for compensating for the manufacturing tolerances of a tube introduced a peristaltic pump have been developed, including means for applying a continuous reaction force on the shoe.

Peristaltic pumps have also been devised that utilize snap-on manifold cartridges having a fixed length U-shaped tube attached, where the cartridge can only be installed one way onto the pump. Such cartridges have also been developed to enable the operator to install the cartridge using a single hand, with the cartridge being a tie bar structure having an attached U-shaped tube.

In fact, the art is extremely crowded with many attempts being made to address the aforementioned limitations and deficiencies of peristaltic pumps that utilize a fixed position pump head and those that feature the use of variable position pump heads as well.

The following issued U.S. Patents are set forth as examples of teachings which illustrate the present state of the art.

U.S. Pat. No. 3,829,249 to Pursley describes a portable siphonic pump for transferring gasoline that includes a motor driven wheel with rollers that squeeze a tube The rollers are retractable along wheel spokes against springs; however there is no showing of a compressive reactive force being used against a shoe.

U.S. Pat. No. 4,728,265 to Cannon describes a peristaltic pump that utilizes a cam action compensator as means to normally urge a peristaltic mechanism toward a platen (compression shoe). The compensator yields as necessary to limit the force the peristaltic mechanism can exert against a tube.

The Cannon patent describes the use of a hinged cam action compensator which provides a yielding or complaint movement between the platen and drive mechanism; however the platen appears to be fixed in all embodiments. It should also be noted that the cam action compensator used by Cannon, and other types of cam action compensators and controls mechanisms, used in the past to provide a yielding or complaint movement between a shoe and drive mechanism against which a tube is compressed, are undesirable from both mechanical complexity and packaging requirements points of view when compared with the invention to be described hereinafter.

U.S. Pat. No. 4,482,347 to Borsanyi describes a low volume peristaltic pump (an application where the present invention finds significant utility), having a resilient surface set into the face of a platen.

U.S. Pat. No. 4,519,754 to Minick describes a peristaltic pump having variable occlusion rates. The pump includes a reaction member further including a "reaction surface adapted to at least partially encircle the circular path traversed" by a set of compression rollers. The reaction member has cam control means associated therewith which enables adjustment of the reaction member so as to select a variable occlusion rate of the tube.

The Minick patent requires a reaction surface to cover about 270 degrees of path travelled by rollers and requires cam control means which, as indicated hereinabove, is undesirable in many applications form mechanical and packaging points of view.

U.S. Pat. No. 3,876,340 to Thomas describes a peristaltic pump having a pivotal reaction means. Each of a plurality of tubes has a support against which it is pressed by the rollers. The support is resiliently yieldable in order to avoid placing excess flattening pressures on the tube.

In a preferred case each support is a spring loaded block which may be of a resilient material. Alternatively, a belt which is spring urged towards the tubes being compressed is also described.

FIG. 3 of the Thomas patent illustrates a peristaltic pump including a floating shoe, single spring and slider crank arrangement (slide pins 42, spring 44 & shoe 36). Each block (shoe) 36 presents a surface 38 which engages the tube and which is yieldable away from the rollers. An adjustment plug 44 is used to adjust the tension on spring 42 and hence the depicted device is not self-adjusting.

U.S. Pat. No. 3,990,444 to Vial describes, with reference to FIG. 3, a blood transfusion apparatus that uses a pair of springs in a slidable member to compress a tube. The pair of springs allows the slidable member to float. A hook device 21 is used to keep the device closed.

U.S. Pat. No. 5,049,047 to Polaschegg et al., describes an infusion pump with means for measuring the internal diameter of a pump supply tube where the means for measuring can be a counterpressure device.

U.S. Pat. No. 4,725,205 to Cannon et al., describes a linear peristaltic pump for pumping medical solutions which uses a complaint means for urging the peristaltic mechanism towards the platen; but which yields to limit force against the tube. The peristaltic means is urged toward the base using cam action compensation means. It should be noted that the Cannon et al. reference describes in great detail one of the significant problems existing in prior art peristaltic pump arrangements, namely that once a particular tube is selected, specific predetermined dimensional limitations are introduced into the combination.

Cannon et al. recognized that the tube itself cannot be expected to provide the necessary resilience to obviate the problem and that rather then absorbing the excess forces with tube resiliency, the effort is more properly focused on ways to limit the force exerted on the tube.

Cannon et al. indicates that one way in which excess forces in a peristaltic can be alleviated is to allow the platen to yield and uses U.S. Pat. No. 4,373,525, to Koboyashi to illustrate a peristaltic pump which makes use of a spring loaded platen (The Koboyashi patent is directed to methods and apparatus for detecting occlusions in tubing).

U.S. Pat. No. 4,705,464 to Arimond describes a medicine pump that includes a pump head having spring loaded plungers for accommodating variances in tubing thickness; but each plunger supports a roller bearing. There is no teaching of spring biasing the compression shoe.

U.S. Pat. No. 4,210,138 to Jess et al., describes fluid metering apparatus that includes a pressure plate slidably mounted to a housing; however the plate is not spring biased.

U.S. Pat. No. 4,648,812 to Kobayashi et al., describes methods and apparatus for preventing pulsations in a peristaltic pump by using a platen mounted on a single support spring.

U.S. Pat. No. 1,998,337 to Spiess, describes a folding machine which includes a roller, a cam mounted on a shaft compressed against the roller.

U.S. Pat. No. 3,737,251 to Berman et al., describes, with reference to FIG. 2, a peristaltic pump having a pair of pump shoes 16, leaf springs 17 and adjusting screws 18 used to compensate for variations in a pump rotor, support bracket, rollers, tubing diameters (inside and outside), concentricity, fluid viscosity and temperature. Berman et al., requires a manual screw to perform the desired compensation function.

U.S. Pat. No. 2,434,802 to Jacobs describes a pump block, for a peristaltic pump, mounted on a pair of springs, with the springs being designed to yield if non-compressible matter traverses the tube. The pump block can be manually adjusted to sit in a predetermined position.

U.S. Pat. No. 3,353,491 to Bastien describes a back-up member 32 for a pumping device, which is in relatively free slidable engagement with a support 12 and is connected thereto only be tension means, such as stretch spring 46*a*, to allow play in the back-up member when an occlusion passes in the tube.

U.S. Pat. No. 4,218,197 to Meyer et al., describes a peristaltic pump and valve flow controller. FIG. 1 depicts a type of tie bar 56, referred to as a frame member, with U-shaped tubing attached thereto. A compression spring 68 is used to compress rollers 66 and the tubing; but the spring is located between tie bar and roller assembly.

U.S. Pat. No. 4,544,336 to Faeser et al., describes a peristaltic pump having a support part 2 acted upon by springs 26 to produce a desired nipping force on a pipe placed between the support and rollers mounted on a wheel.

U.S. Pat. No. 4,585,399 to Baier describes a hose pump, for drawing fluids from a body cavity, with different inlet and outlet connectors to prevent improper installation.

U.S. Pat. No. 4,599,055 to Dykstra describes a fluid flow chamber cassette carrying a U-shaped flexible tube on one side that is loaded into a peristaltic pump. In particular, FIG. 1 of the Dykstra patent depicts a peristaltic pump including a snap on cassette 28 and U-shaped tube 30, having a fixed length. It is possible to install Dykstra's cassette using one hand.

U.S. Pat. No. 4,708,604 to Kindera describes a pressure plate, for a peristaltic pump utilizing flexible tubing, having an arcuate surface and a pivot mount. The arcuate surface is retained in operative association with the flexible tubing by a spring bias.

U.S. Pat. No. 4,861,242 to Finsterwald describes a self loading peristaltic pump.

U.S. Pat. No. 5,082,429 to Soderquist et al., describes a peristaltic pump that uses a camming mechanism for opening and closing the pump.

U.S. Pat. No. 4,824,339 to Bainbridge et al., describes a cartridge for use with the self loading peristaltic pump described in the 4,861,242 patent to Finsterwald.

U.S. Pat. No. 5,024,586 to Meiri describes a peristaltic pump that corrects for tube walking (also referred to as "tube creep") using spring biased rollers to apply a constant force to the tube. The spring biased rollers apply a force that is substantially independent of minor tube wall thickness variations.

U.S. Pat. No. 5,110,270 to Morrick describes a peristaltic pump that uses a spring and slider combination; but on the pump rotor, using spring biased clamps to hold a tube in place.

U.S. Pat. No. 5,173,038 to Hopfensperger et al., describes a rotatable compression member for a peristaltic pump including a leaf spring.

U.S. Pat. Nos. 3,137,241 and 3,227,091 to Isreeli and Isreeli et al., respectively, describe a spring biased platen for a pumping device.

U.S. Pat. No. 3,167,397 to Skeggs et al., describes a spring biased (or possibly supported) platen for an analysis system including a pump.

U.S. Pat. No. 4,473,342 to lies describes, with reference to FIG. 7, a peristaltic pump that includes a plurality of pivotably mounted track members provided with an associated leaf spring (36) which is fixed at one end to the underside of track carrier for biasing a track member toward the rollers 3 and can act to compensate for variations in tube wall thickness. The lies patent requires pivotably mounted track members.

U.S. Pat. No. 4,673,334 to Allington et al. describes a cassette for a peristaltic pump having spring means for engaging the drive means of the pump with a bias force to permit self adjustment. The cassette acts as a compression shoe.

U.S. Design Pat. No. 264,134 to Xanthopoulos depicts a disposable cassette for a peristaltic pump.

U.S. Pat. No. 4,025,241 to Clemens describes a peristaltic pump having pump tubing compressed against a spring loaded (pair of springs) movable base member improved by the addition of at least one actuating member capable of movement to or away from an actuating position with respect to the base member.

U.S. Pat. No. 3,778,195 to Bamberg describes a pump for parenteral injections and the like including pivotally mounted spring loaded plate like members positioned for engagement with a cam lobe.

U.S. Pat. No. 5,125,891 to Hossain et al., U.S. Pat. No. 4,798,580 to DeMeo et al., and U.S. Pat. No. 4,537,561 to Xanthopoulos, teach disposable peristaltic pump cassette systems.

U.S. Pat. No. 4,604,038 to Belew describes a remotely operable peristaltic pump requiring the use of two compression shoes.

U.S. Pat. No. 4,500,266 to Cummins describes a peristaltic pump that uses a series of gear driven compensating shoes that linearly move in and out of contact with a tube.

U.S. Pat. No. 3,918,854 to Catarious describes the use of a spring biased shoe to compensate for a variety of problems in a peristaltic pump; however only a manual compensation mechanism is described.

U.S. Pat. No. 4,813,855 to Leveen et al., describes the use of an adjustable shoe in a peristaltic pump, that is positioned using a cam shaft.

U.S. Pat. No. 4,189,286 to Murry et al., describes a peristaltic pump that uses a compressive reactive force for tube sizing. A cam mounting is required and a pivot shaft is called for. Additionally, the shoe used in Murry et al. rotates.

U.S. Pat. No. 4,256,442 to Lamadrid et al., describes use of a mechanically advantaged pressure plate for a peristaltic pump; however, the pressure plate, which is pivot mounted, is retained in one of two positions and does not "float".

U.S. Pat. No. 4,288,205 to Henk describes a variable volume peristaltic pump that uses a manual adjustment screw to adjust the effective length of a flexible band located between the tube and pump rollers.

U.S. Pat. No. 4,886,431 to Soderquist et al. describes a peristaltic pump that cooperates with independently adjustable cartridges.

U.S. Pat. No. 4,925,376 to Kahler describes a peristaltic pump with a tube holding mechanism that requires the use of a cam shaft to effect shoe movement and the use of a locking surface to prevent tube walking.

None of the aforementioned patents, or indeed any known peristaltic pump, satisfactorily address the problem of assuring a consistent pumping action, which affects fluid delivery rate (particularly for those applications involving the pumping of small volumes of fluid); while at the same time addressing (1) the mechanical complexity, cost and space limitations imposed by cam action compensation means used in conjunction with variable position pump shoes; (2) the safety issues associated with insuring that a tube introduced into a pump is properly installed, that the tube does not walk or be subject to forces that increase the risk of tube spilling, etc.; (3) the concern that the manual operation required to introduce a tube is a user friendly, preferably one handed, operation; and (4) the need to automatically compensate for manufacturing tolerances in tube wall and shoe construction without requiring manual intervention, such as by having to turn manual adjustment screws or the like to perform the compensation function.

In view of the above, it would be desirable to provide methods and apparatus which, when integrated into a peristaltic pump, simultaneously solve all of the aforementioned problems, and which provide the capability to solve individual problems such as simplifying the mechanical aspects of the aforementioned automatic compensation function, relaxing the packaging constraints for such means, offering a control mechanism that is simple and easy to use from a manual operations point of view, etc.

SUMMARY OF THE INVENTION

Accordingly, it is a general object of the invention to provide an improved peristaltic pump which is mechanically simple, low in cost, safe and convenient to use.

More specifically, it is an object of the invention to provide methods and apparatus for automatically compensating for the manufacturing tolerances of a tube introduced into a peristaltic pump to reduce the sensitivity of such pumps to tubing, part and assembly tolerances.

It is a further object of the invention to provide an improved peristaltic pump that accurately and consistently pumps fluids, particularly small volumes of fluid, thereby reducing the potential for fluid delivery rate to vary from operation to operation improving pump efficiency, efficacy and safety.

Furthermore, it is an object of the invention to provide a user friendly peristaltic pump that can be loaded with one hand in a manner that inherently insures that the inserted tubing properly installed.

Another object of the invention is to provide a peristaltic pump that cooperates with a manifold safety cartridge that is keyed to prevent improper cartridge installation, thereby assuring that any tube attached to the cartridge is properly installed in the pump.

It is still another object of the invention is to provide the aforementioned safety manifold cartridge in a form that is inexpensive from a manufacturing point of view and preferably a disposable.

Yet another object of the invention is to provide a single control which allows a tube to be easily loaded into a peristaltic pump, and allows a variable position pump shoe to be positioned and then be locked in place while a continuous reaction force is applied to the shoe.

Still another object of the invention is to include within the aforementioned single control, means for automatically compensating for variations in tube construction.

A further object of the invention is to provide the aforementioned single control in the form of a mechanically simple actuating means that can be conveniently packaged and easily used in an adjustable pump head assembly.

A still further object of the invention is to provide methods and apparatus which reduce the potential for tube walking in a peristaltic pump.

It is an object of the invention to provide methods and apparatus which facilitate the use of compressible tubing, having a wide range of tube thickness, in a peristaltic pump, without decreasing pumping efficiency or tube life.

Further yet, it is an object of the invention to provide a peristaltic pumping device, and associated methods and apparatus for use in such devices, which reduce the trauma to tubing used during the pumping operations.

It is a still further object of the invention to provide methods and apparatus for use in conjunction with peristaltic pumping devices, which reduce the risk of tube spilling, which extend tube life, and reduce volumetric flow errors that result from variations in tubing wall thickness.

Yet another object of the invention is to provide methods and apparatus which automatically vary the occlusion rate of a compressible tube introduced into a peristaltic pump.

Still another object of the invention is to provide a peristaltic pump which is easy to manufacture and which does not require extremely close tolerances between its mechanical components for proper assembly and operation.

According to the invention the aforementioned objects may be accomplished by utilizing a peristaltic pump that, in the manner to be described hereinafter, assures a consistent pumping action by using novel actuating means for a self-adjusting pump head assembly that includes a variable position pump shoe slidably attached to a base, and a disposable safety manifold cartridge, removably attached to the base, to which the ends of a tube are attached.

The tube may be introduced into the pump, when the pump head is in a first ("open") position, by attaching the cartridge to the base. When the pump head is in a second ("closed") position, the tube is compressed between the aforementioned shoe and a rotatable mandrel having at least one roller located on its periphery. As the mandrel rotates, fluids within the tube are subject to the pumping action that occurs when the tube is periodically occluded by the roller(s) squeezing the tube against the shoe.

The pump contemplated by the invention assures a consistent pumping action by utilizing a single control for positioning, locking and applying a continuous reaction force on the adjustable (variable position) pump shoe used to compress the tube introduced into the pump.

The control automatically compensates for manufacturing tolerances in tube wall and shoe construction using the novel actuating means that, in a preferred embodiment of the invention, includes a control knob (for translating rotational motion into linear motion), in combination with cranking means, pivotally attached to the knob and the adjustable shoe, that includes a linkage or pair of links carrying a helical compression spring.

The disposable safety manifold cartridge contemplated by a preferred embodiment of the invention includes an asymmetrical tie bar which directs the operator to properly orient the cartridge being installed. The asymmetrical tie bar is designed to cooperate with at least one "key" ridge formed on the aforementioned base. As indicated hereinbefore, this keying process insures that a tube introduced into the pump will be properly installed since the key ridge(s), according to this one aspect of the invention, will interfere with cartridge installation if the cartridge is not oriented in a predefined acceptable manner.

Use of such a cartridge in conjunction with the single control referred to hereinabove, also makes the introduction of a tube into the pump a user friendly, one handed, operation.

More specifically, a first aspect of the invention may be characterized as actuating means for a self-adjusting pump head assembly, including a variable position pump shoe slidably attached to a base, wherein the assembly is used to pump liquids through a tube introduced into a peristaltic pump, including (a) means for translating rotational motion into linear motion, and (b) cranking means, including means for automatically compensating for the manufacturing tolerances of a tube introduced into the pump, pivotally attached to both the means for translating and the shoe.

As indicated hereinabove, the means for automatically compensating preferably includes a linkage or pair of links, carrying a helical compression spring, pivotally anchored to both the means for translating and the shoe.

A further aspect of the invention may be characterized as a peristaltic pump per se where the pump includes (a) a self-adjusting pump head, including a variable position pump shoe slidably attached to a base; and (b) a control for positioning, locking and applying a continuous reaction force on the shoe to compress the tube between the shoe and at least one roller located on the periphery of the mandrel, wherein the control further comprises means for translating rotational motion into linear motion, and cranking means, including means for automatically compensating for the manufacturing tolerances of a tube introduced into the pump, pivotally attached to both the means for translating and the shoe.

The pump may be alternatively characterized, as indicated hereinabove, as including a disposable manifold safety cartridge, removably attached to the base, to which the ends of the tube are attached; with the cartridge being formed to include an asymmetrical tie bar that is keyed onto the base to insure that the cartridge is oriented in an acceptable manner and that the tube introduced into the pump will be properly installed.

A still further aspect of the invention is directed to a control for a peristaltic pump used to pump liquids through a tube introduced into the pump, wherein the peristaltic pump includes a rotor assembly having a rotating mandrel portion with at least one roller located on the periphery of the mandrel, and a self-adjusting pump head assembly including a variable position pump shoe slidably attached to a base, comprising: (a) means for positioning the variable position pump shoe such that in a first position a tube may to be inserted into the pump, and in a second position the tube is compressed between the pump shoe and the at least one roller located on the periphery of the mandrel; and (b) pivotable slider crank means, for locking the variable position pump shoe in the second position and for automatically applying a continuous reaction force on the variable position pump shoe whenever the shoe is locked in the second position to thereby automatically compensate for the manufacturing tolerances of a tube introduced into the pump.

The invention is also directed to the methods employed by the apparatus for actuating and controlling the operation of a peristaltic pump that is described in detail hereinafter.

In general, the invention features a peristaltic pump and pump components, such as a control (actuating means) for the pump and a disposable safety manifold cartridge use with the pump, that are mechanically simple, low in cost, safe and convenient to use.

More particularly, the invention features methods and apparatus which enable peristaltic pumps: (1) to automatically compensate for the manufacturing tolerances of tubes introduced into the pumps and reduce the sensitivity of such pumps to tubing, part and assembly tolerances; (2) to consistently pump fluids, particularly small volumes of fluid; (3) to be loaded with one hand in a manner that inherently insures that inserted tubing is properly installed; (4) to perform the aforementioned compensation function using a single control that is mechanically simple, and can be conveniently packaged and easily used in an adjustable pump head assembly; (5) to prevent tube walking, extend tube life and help prevent tube spilling.

These and other objects, embodiments and features of the present invention and the manner of obtaining them will become apparent to those skilled in the art, and the invention itself will be best understood by reference to the following Detailed Description read in conjunction with the accompanying Drawing.

BRIEF DESCRIPTION OF THE DRAWINGS

FIG. 3A is an isometric assembly view of a set of illustrative components that may be used to fabricate the cranking means (including compensation means), and the translation means portions of the aforementioned actuating means; FIG. 3B is an isometric assembly view of the entire assembly depicted in FIG. 3A, indicating how the FIG. 3A assembly may be attached to a pump shoe; and FIG. 3C is an isometric assembly view of the entire assembly depicted in FIG. 3B and how the pump shoe and knob portions of such assembly may be respectively slidably and rotatably attached to the base depicted in FIG. 2.

DETAILED DESCRIPTION OF THE INVENTION

Figure 1A:
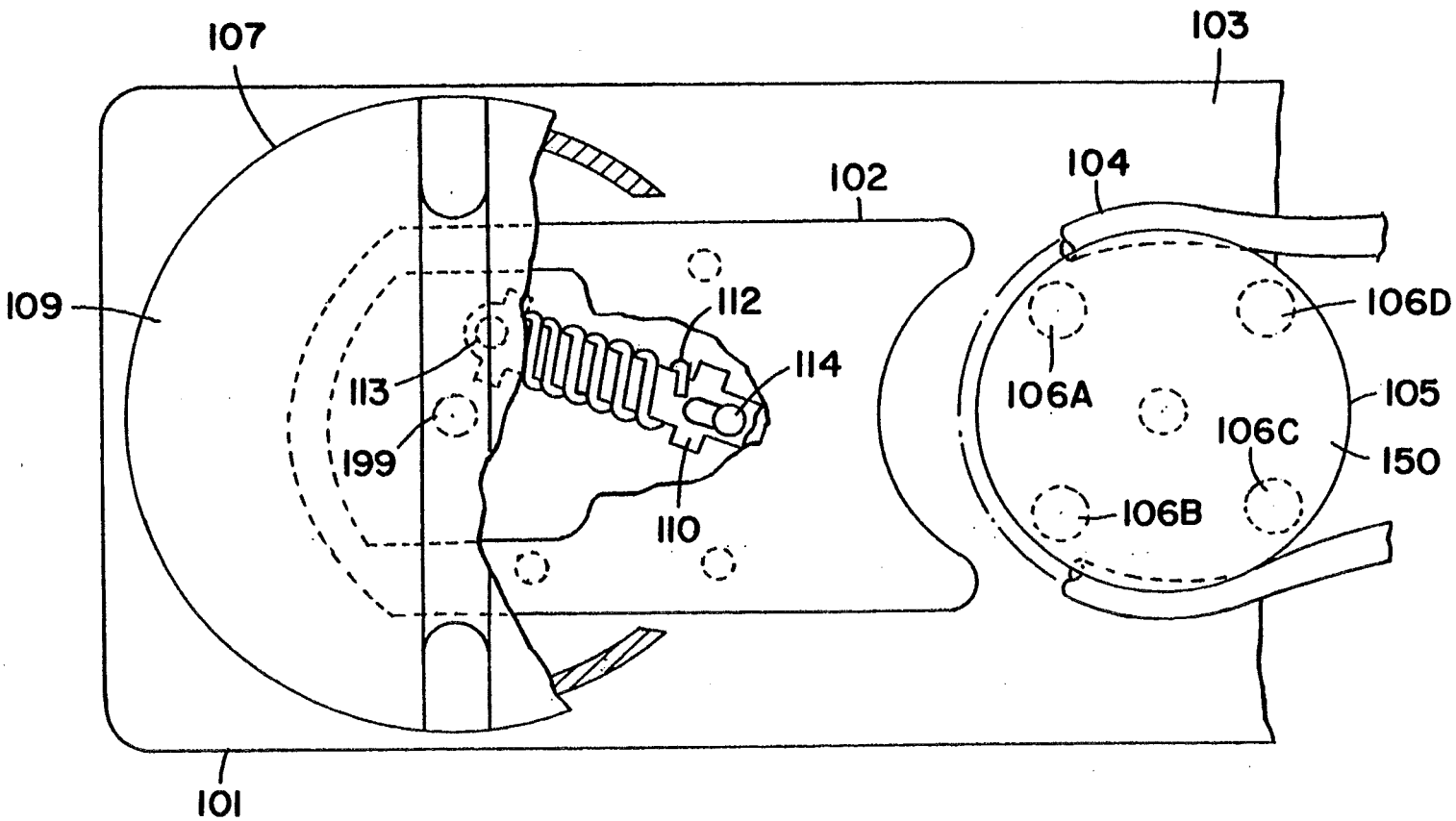
FIG. 1A is a plan view of a self adjusting pump head assembly, of the type contemplated by a preferred embodiment of the invention, depicting a variable position pump shoe in an "open" position, i.e., a position that allows a tube to be inserted into or be removed from the depicted assembly.

Reference should now be made to FIG. 1A which, as indicated hereinabove, illustrates a self adjusting pump head assembly (assembly 101) for a peristaltic pump of the type contemplated by a preferred embodiment of the invention. Assembly 101 is shown to include a variable position pump shoe 102 which is slidably attached to base 103 (in a manner to be described hereinafter with reference to FIG. 2 and FIGS. 3A–3C), in an "open" position.

The depicted open position of pump shoe 102 allows a tube, such as tube 104, to be inserted into or be removed from the cavity formed between pump shoe 102 and rotor assembly 105, also depicted in FIG. 1A. Rotor assembly 105 is shown to include at least one roller (rollers **106*a*–106*d* in FIG. 1A), spaced about the periphery of a mandrel, 150**.

In the illustrative example depicted in FIG. 1A, rollers **106*a*–106*d* are used to periodically occlude a tube interposed between the rollers and pump shoe 102 as mandrel 150 rotates. The desired occlusion takes place when pump shoe 102 compresses tube 104 against the rollers, as illustrated in FIG. 1B where tube 104 is shown compressed between pump shoe 102 and rollers 106*a*–106*b***, providing the peristaltic pumping action well known to those skilled in the art.

Additionally, FIG. 1A depicts actuating means 107 which includes the combination of: (a) means for translating rotational motion into linear motion, (shown in the illustrative embodiment of the invention depicted in FIG. 1A as knob 109), and (b) cranking means, including compensation means for automatically compensating for the manufacturing tolerances of a tube introduced into the pump, where the compensation means is depicted in FIG. 1A as the combination of spring 112 and slider crank 110. The compensation means combination is shown pivotally attached to the translation means via screw 113, and attached to pump shoe 102 via screw 114. These attachments are made in a manner that will allow the slider crank 110/spring 112 combination to slide and compensate for the manufacturing tolerances of tube 104 when pump shoe 102 compresses tube 104 against the rollers of rotor assembly 105 as shown in FIG. 1B.

Reference should once again be made to FIG. 1B which, as indicated hereinabove, illustrates self adjusting pump head assembly 101 having variable position pump shoe 102 in a "closed" position (i.e., a position in which tube 104 is compressed between shoe 102 and the rollers (**106*a*–106*b*) facing shoe 102 on the periphery of rotor assembly 105**.

Figure 1B:
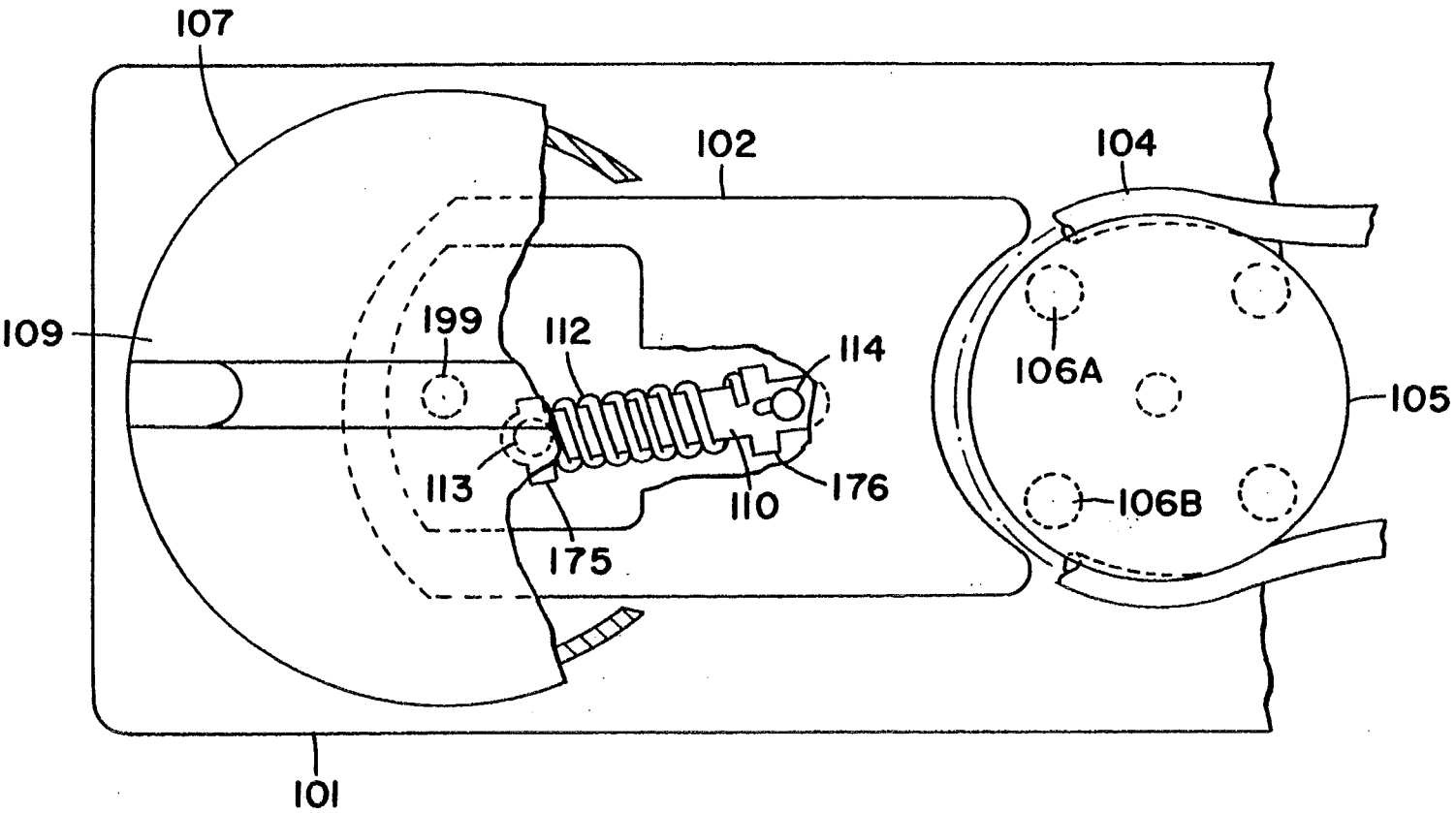
FIG. 1B is a plan view of a self adjusting pump head assembly, of the type contemplated by a preferred embodiment of the invention, depicting a variable position pump shoe in a "closed" position, i.e., a position in which a tube inserted into the assembly is compressed between the shoe and a rotor assembly having a rotating mandrel portion with a plurality of rollers spaced around the periphery of the mandrel.

It should be noted with reference to FIG. 1B that actuating means 107 is in a different position from that shown in FIG. 1A. In particular, knob 109 is shown rotated from a first position (the position shown in FIG. 1A), to a second position (the position shown in FIG. 1B).

According to the invention, this rotational motion is translated by the combination of knob 109 and slider crank 110, into linear motion that re-positions pump shoe 102 from the position shown in FIG. 1A, to the position shown in FIG. 1B. This is accomplished, according to the invention, by the rotating knob 109 to cause slider crank 110, shown pivotally attached to both knob 109 and pump shoe 102 via screws 114 and 113, respectively (as indicated hereinabove), to pivot from the position shown in FIG. 1A, to the position shown in FIG. 1B.

According to a preferred embodiment of the invention, slider crank 110 stays "locked" in place when depicted knob 109 is in the closed position (the position shown in FIG. 1B). This may be accomplished, according to the illustrative embodiment of the invention being presented with reference to FIGS. 1A–1C, by turning knob 109 clockwise slightly beyond the pivot point 199 (the pivot point for screw 113), when rotating knob 109 from the open to the closed position. In this orientation any back pressure on pump shoe 102 will insure that slider crank 110 stays locked until knob 109 is rotated counterclockwise back past pivot point 199.

Figure 1C:
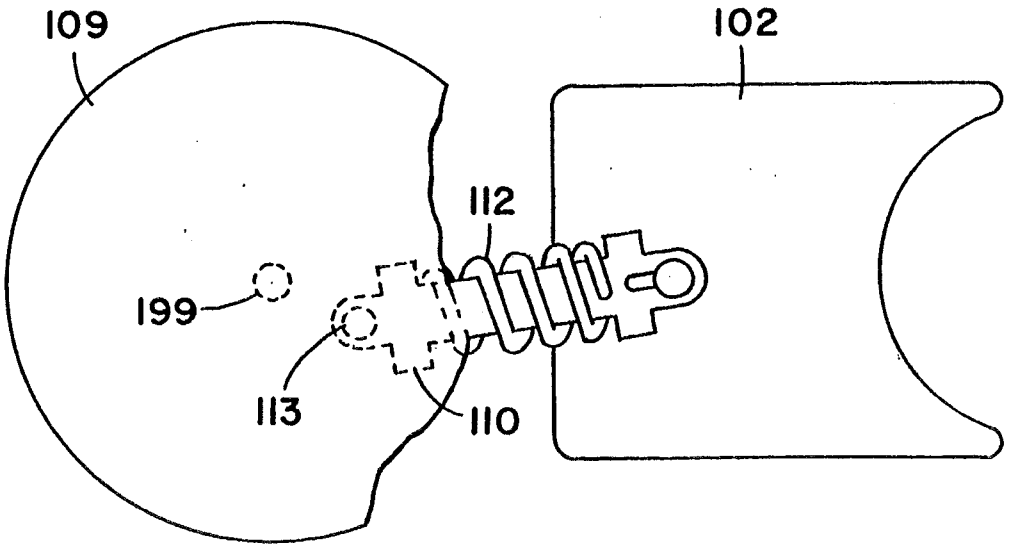
FIG. 1C is an exploded plan view of a combination of a subset of the components depicted in FIG. 1B that, when oriented as shown in FIG. 1C, serve as a locking mechanism for the self adjusting pump head assembly (depicted in FIG. 1B) when the assembly is in the "closed" position.

The locking mechanism is depicted in greater detail in FIG. 1C which is an exploded plan view of the combination of knob 109, slider crank 110, spring 112 carried by slider crank 110, and pump shoe 102, after knob 109 is rotated into the closed position, with slider crank 110 oriented as shown in FIG. 1C, where screw 113 is positioned beyond pivot point 199.

When slider crank 110 is locked in the position shown in FIG. 1B, the compensation means (the aforementioned combination of spring 112 and slider crank 110), is operative to forward bias pump shoe 102 toward said rotor assembly 105 and is further operative to apply a continuous reaction force on pump shoe 102 to automatically compensate for the manufacturing tolerances of a tube, like tube 104. The aforementioned biasing and compensation functions may be easily accomplished by proper selection of spring 112. The criteria for choosing spring 112 is that it must, when carried as part of depicted slider crank 110, be tense enough to have the desired forward biasing effect; yet be resilient enough to simultaneously perform the desired compensation function.

The best spring to use for a given application may depend, for example, on the load exerted by the pump shoe, a range of valid tube thickness, the space between the depicted spring retainer cross members on slider crank 110 (with cross members 175 and 176 being called out for the sake of illustration in FIG. 1B), etc., and may be chosen empirically without limiting the scope or spirit of the invention.

Figure 2:
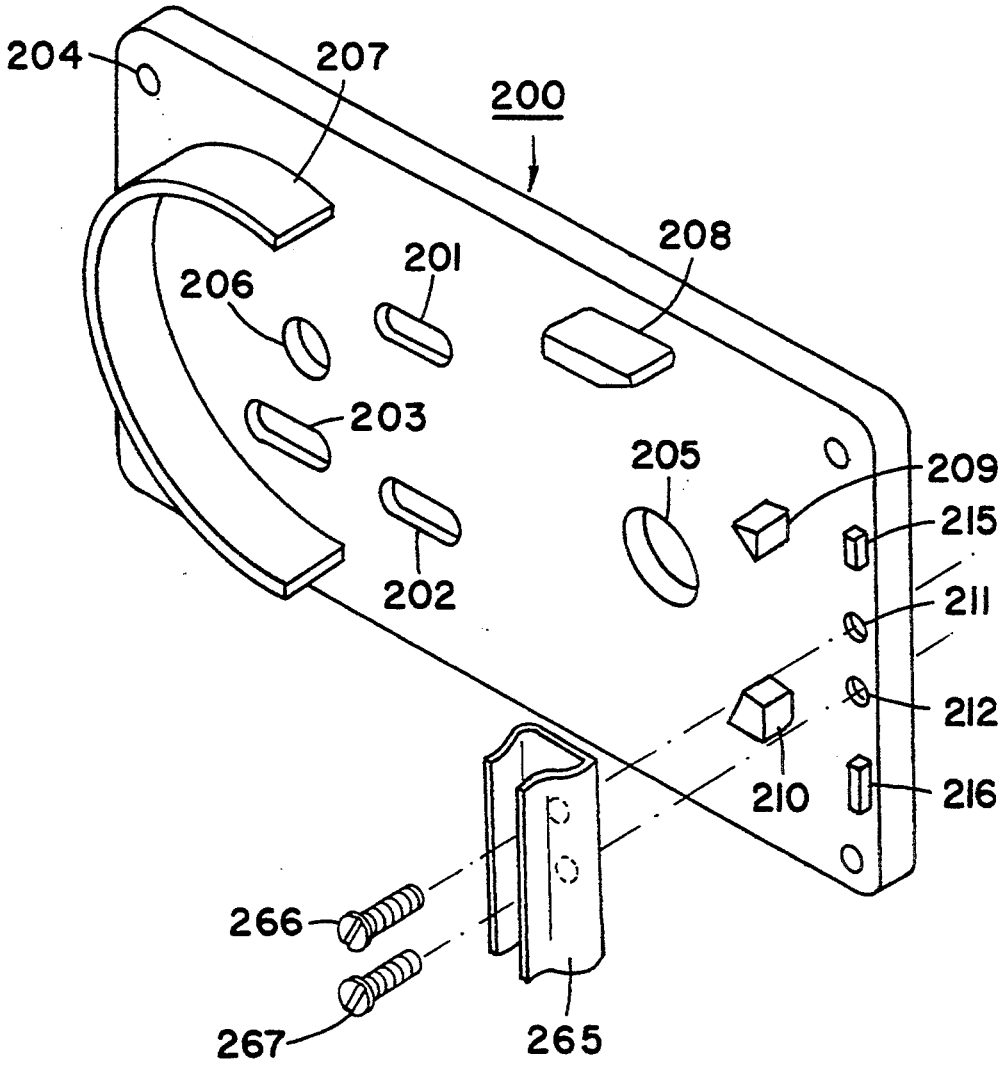
FIG. 2 is an isometric view of an illustrative base upon which a self adjusting pump head assembly of the type contemplated by the invention may be assembled.

Reference should now be made to FIG. 2 which, as indicated hereinbefore, depicts an illustrative base 200 upon which a self adjusting pump head assembly of the type depicted in FIG. 1A and FIG. 1B, may be assembled.

In particular, base 200 is, according to a preferred embodiment of the invention, a molded component which may, for example, be fabricated using metal or a plastic; and is shown to include: elongated slots 201, 202 and 203, which may be used as guides for a variable position pump shoe (like pump shoe 102 of FIG. 1A) affixed to the base; at least one aperture, like aperture 204, through which means (such as a screw) may be introduced for securing base 200 to the surface of a cabinet housing the pump motor; aperture 205, which would allow base 200 to be mounted over a rotor assembly, like rotor assembly 105 of FIG. 1A; aperture 206, which is designed to allow the center pivot point for knob 109 of FIG. 1 to be secured behind base 200; knob stabilizing member 207 which, according to a preferred embodiment of the invention, is used to increase the stability of knob 109; safety members 208, 209 and 210 which, according to a preferred embodiment of the invention, help protect an operator's fingers from being caught between rotor assembly 105 and tube 104; apertures 211 and 212 which, according to a preferred embodiment of the invention, hold clip 265 (secured via screws 266 and 267), into which the safety manifold cartridge contemplated by one aspect of the invention (to be described in detail hereinafter with reference to FIG. 4), may be removably attached; and illustrative key ridges 215–216, designed to cooperate with the aforementioned safety manifold cartridge to insure proper cartridge orientation and proper tube installation.

Figure 3A:
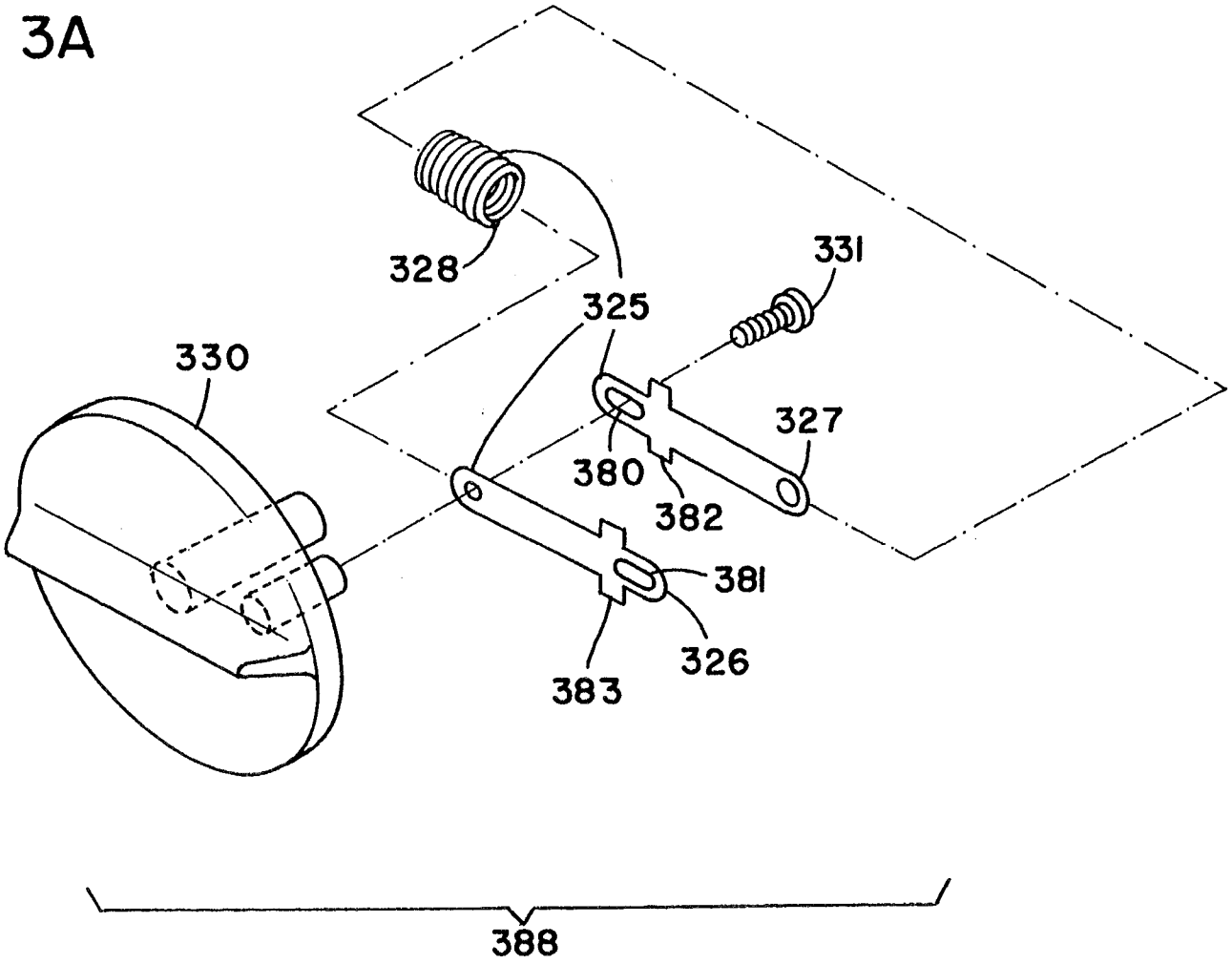
FIGS. 3A–3C depict an example of a set of suitable components for realizing the actuating means contemplated by the invention and how these components may be assembled. In particular.
Figure 3B:
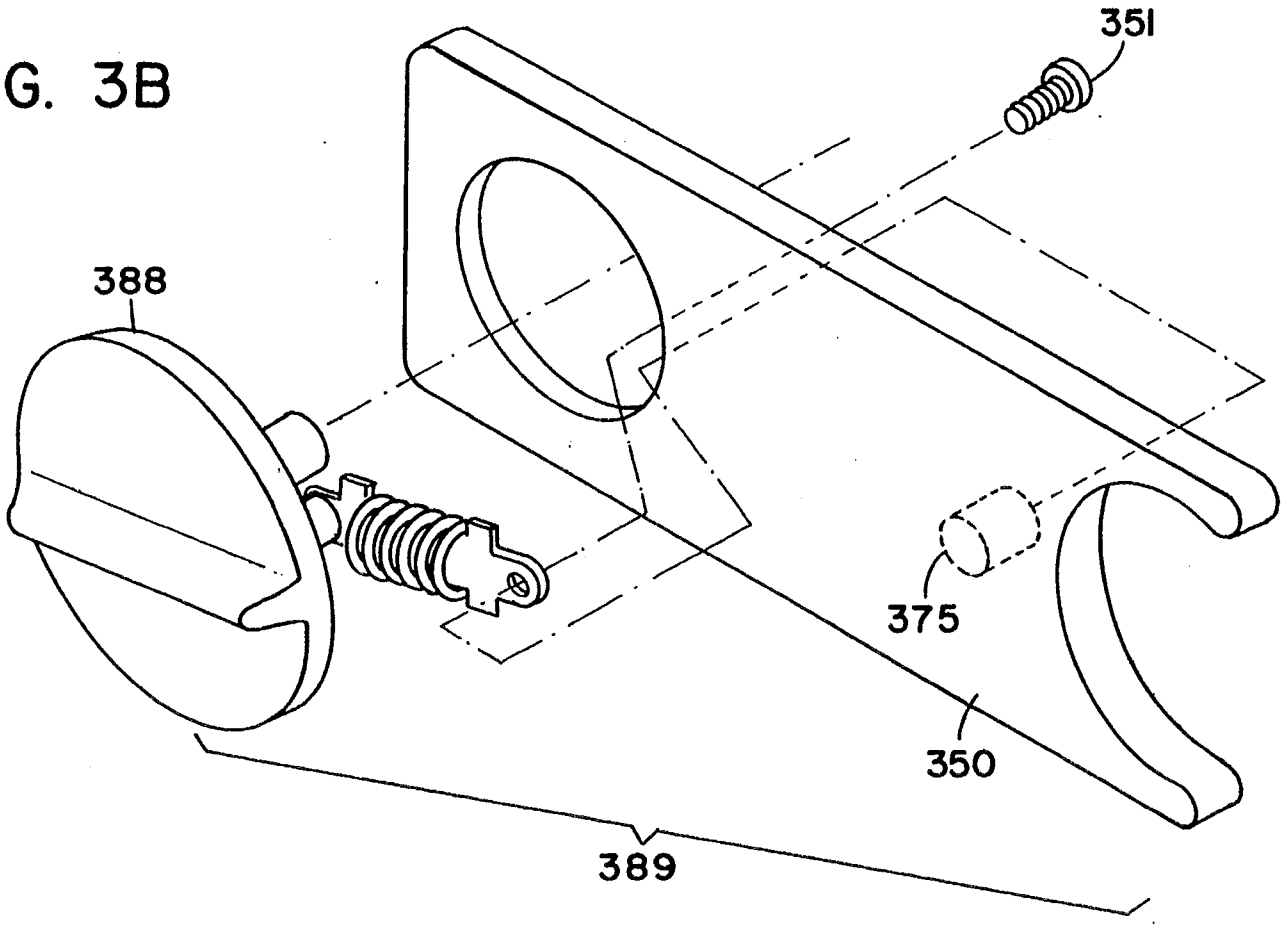
Figure 3C:
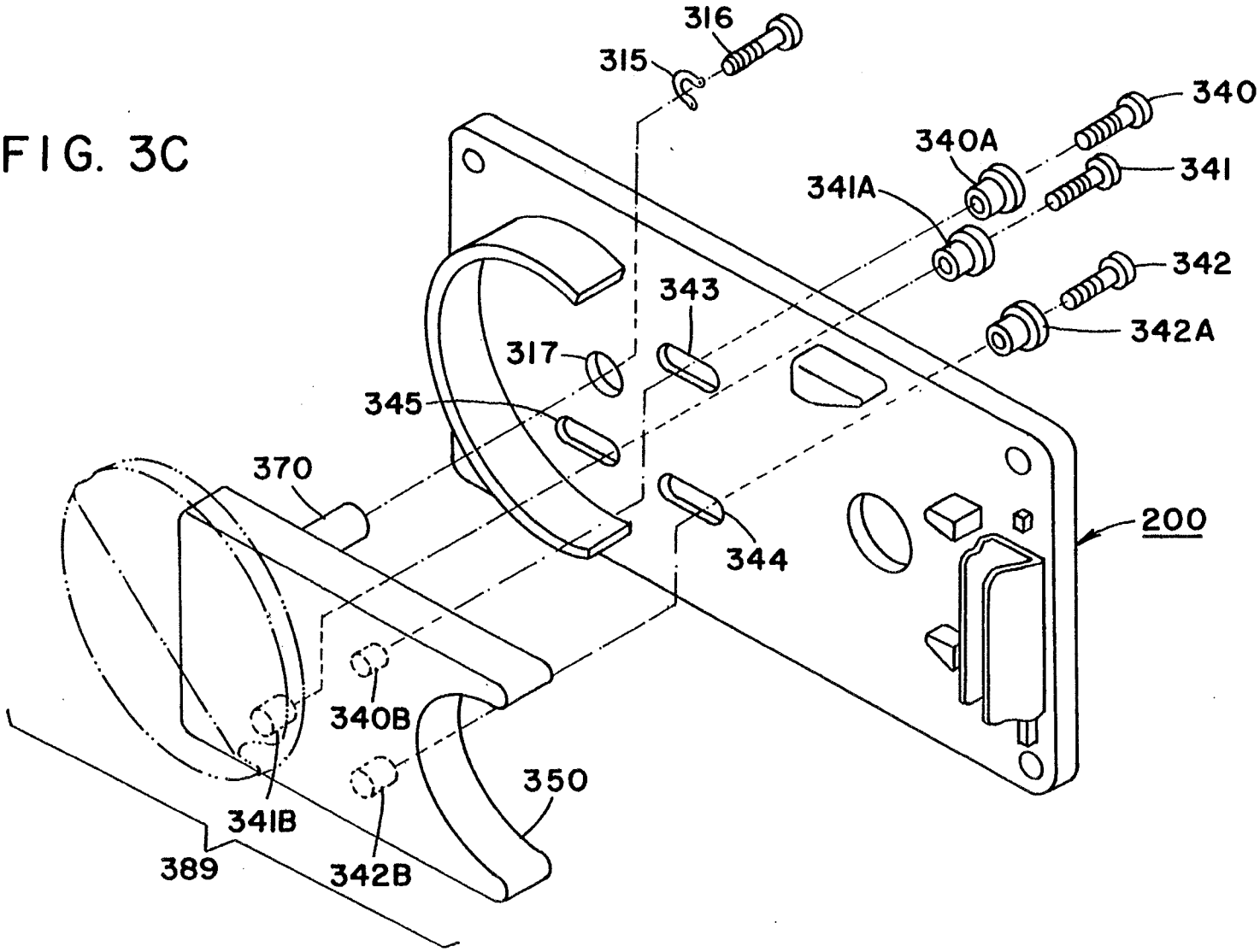

Reference should now be made to FIGS. 3A–3C which, as indicated hereinabove, depict an example a set of suitable components for realizing actuating means 107 and how these components may be assembled to realize the objectives of the invention.

As indicated hereinbefore, FIG. 3A is an isometric assembly view of a set of illustrative components that may be used to fabricate the cranking means (including compensation means), and the translation means portions of the actuating means 107.

In particular, FIG. 3A depicts exemplary compensation means 325 as the combination of a pair of links (first spring plate 326 and second spring plate 327), carrying a helical compression spring 328; where compensation means 325 is attached to knob 330 via screw 331 to provide a vehicle for translating rotary motion into linear motion.

Spring plates 326 and 327 are preferably assembled in opposing fashion as shown in FIG. 3A, with elongated slots 380 and 381, adjacent to spring retaining cross members 382 and 383 respectively. When assembled as shown in FIG. 3A, spring retaining cross members 382 and 383 are used to retain compression spring 328; and elongated slots 380 and 381 allow spring plates 326 and 327 to slide in opposing fashion.

Reference should now be made to FIG. 3B which, as indicated hereinbefore, is an isometric assembly view of the entire assembly depicted in FIG. 3A (assembly 388), depicting how assembly 388 may be attached to a pump shoe.

In particular, FIG. 3B illustrates assembly 388 as being attached to pump shoe 350 by means of screw 351 (set into molded boss 375 shown as part of shoe 350), to form actuating means 107 as shown in FIGS. 1A–1B.

Reference should now be made to FIG. 3C which, as indicated hereinbefore, is an isometric assembly view of the entire assembly depicted in FIG. 3B and how the pump shoe and knob portions of such assembly may be respectively slidably and rotatably attached to the base depicted in FIG. 2.

In particular, the knob portion of actuating means 107 may be rotatably attached to base 200 by securing assembly 389 (of FIG. 3B) to the base utilizing, for example, the spring washer 315 and screw 316 combination shown in FIG. 3C. More particularly, FIG. 3C illustrates knob post 370 passing through aperture 317 in base 200 and being rotatably secured thereto via the aforementioned spring washer and screw combination. It should be noted that aperture 317 in FIG. 3C corresponds to aperture 206 as shown in FIG. 2.

Further reference should be made to FIG. 3C for an illustration of how the pump shoe portion of the actuating means contemplated by the invention may slidably attached to a base to allow the pump shoe to engage in linear motion.

In particular, the pump shoe portion of assembly 389, shown in FIG. 3B as pump shoe 350, may be slidably attached to base 200 via screws 340–342 and flanged plastic spacers **340*a*–342*a*, with screws 340–342 being set into molded posts 340*b*–342*b* of pump shoe 350 (as shown in FIG. 3C). According to this illustrative embodiment of the invention, spacers 340*a*–342*a* may be installed through elongated slots 343–345 shown in FIG. 3C (corresponding to slots 201–203 of FIG. 2); with the spacers serving as rollers which enable the pump shoe to vary in position linearly, along the path of elongated slots 343–345, as the knob 388 portion of assembly 389** (shown in FIG. 3B), is rotated.

To complete the assembly of a peristaltic pump of the type contemplated by the invention, fully assembled base 200 (assembled, for example, as indicated in FIG. 3C) is installed over the pump's rotor assembly (such as rotor assembly 105 shown in FIGS. 1A–1B), with the rotor assembly passing through aperture 205 shown in FIG. 2.

Figure 4:
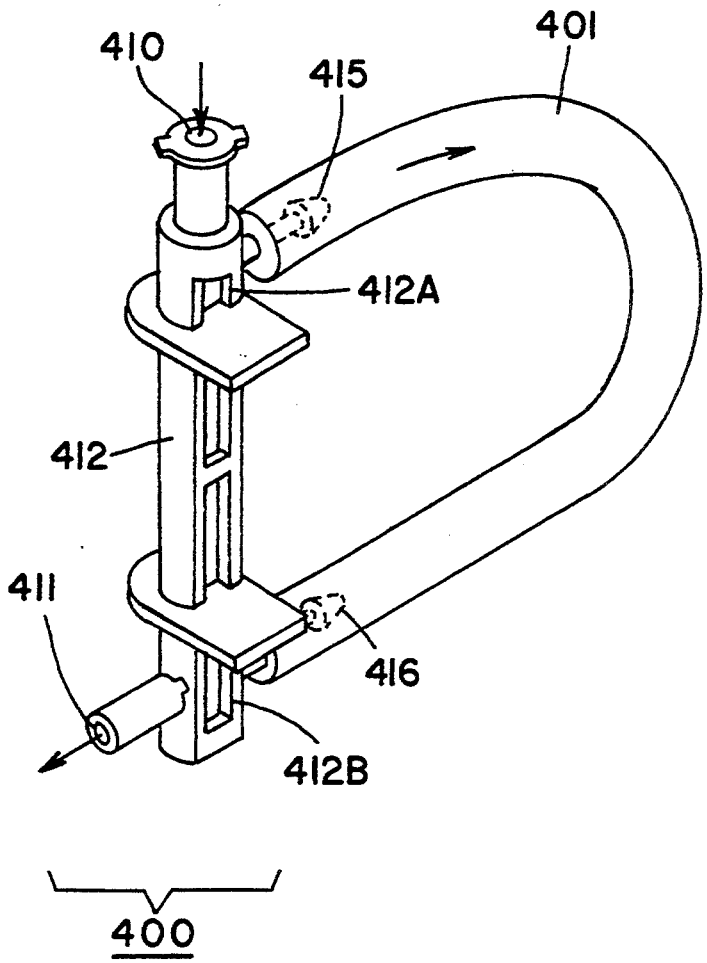
FIG. 4 is an isometric view of an illustrative disposable safety manifold cartridge of the type contemplated by the invention. Such cartridge may be used, in cooperation with a base of the type depicted in FIG. 2, to insure that a tube introduced into the pump is properly installed and make the introduction of the tube a user friendly, one handed, operation.

Reference should now be made to FIG. 4 which, as indicated hereinbefore, is an isometric view of an illustrative disposable safety manifold cartridge of the type contemplated by the invention. Such cartridge may be used to insure that a tube introduced into the pump is properly installed and make the introduction of the tube a user friendly, one handed, operation.

In particular, FIG. 4 depicts the combination of molded manifold 400 (which includes an input port 410, an output port 411 and tie bar 412), with nipple 415 (located at the input end of manifold 400), nipple 416 (located at the output end of manifold 400) and with tubing 401, the ends of which are shown attached to nipples 415 and 416.

According to a preferred embodiment of the invention, tie bar 412 is asymmetrically formed as shown in FIG. 4 to prevent improper cartridge installation when the illustrative cartridge is clipped onto base 200 using, for example, clip 265 shown in FIG. 2.

In particular, tie bar 412 is asymmetrically formed such that cavities **412*a* and 412*b* will cooperate with the illustrative key ridges (key ridges 215–216) shown on exemplary base 200 depicted in FIG. 2. Those skilled in the art will readily appreciate that a keying process may be used to insure that a tube introduced into the pump will be properly installed since illustrative key ridges 215–216, as shown in FIG. 2**, will interfere with cartridge installation if the cartridge is not oriented in a predefined acceptable manner defined by the size and shape of the key ridges and cavities.

The safety manifold cartridge depicted in FIG. 4 may be fabricated using inexpensive plastics that, according to one embodiment of the invention, provide a safety manifold cartridge which is a disposable item.

Figure 5A:
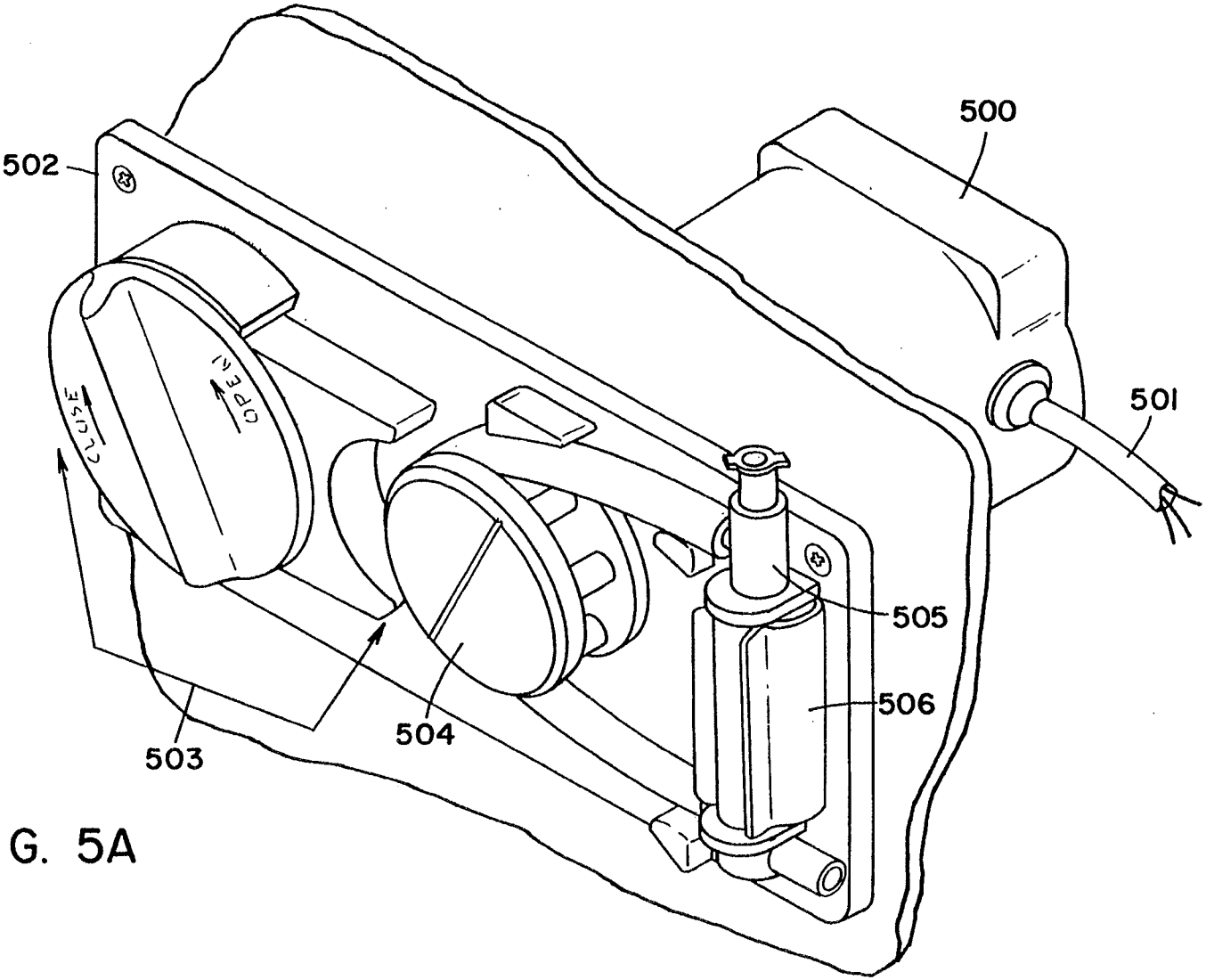
FIG. 5A is an illustrative assembly view of a peristaltic pump including the actuating means contemplated by the invention, where the actuating means in an open position.
Figure 5B:
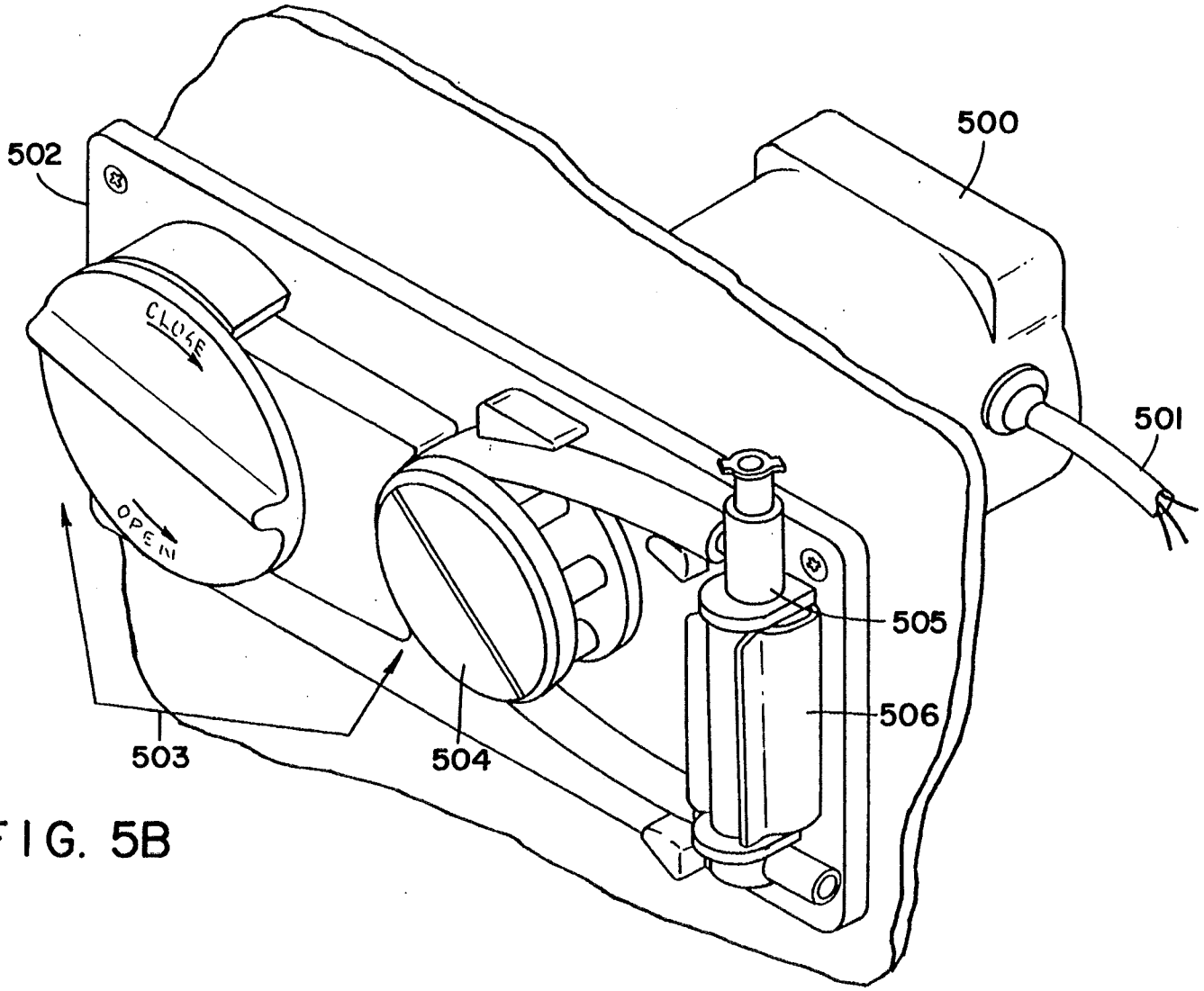
FIG. 5B is an illustrative assembly view of a peristaltic pump including the actuating means contemplated by the invention, where the actuating means in a closed position.

Finally, reference should be made to FIGS. 5A–5B which illustrate an assembly view of a peristaltic pump, including actuating means contemplated by the invention, where the actuating means in an open position (FIG. 5A), and where the actuating means in a closed position (FIG. 5B).

In particular, FIG. 5A depicts illustrative pump motor 500 with power cord 501 attached thereto, located in back of base 502. Actuating means 503, of the type contemplated by the invention and described in detail hereinbefore, is shown mounted on the front face of base 200, with rotor assembly 504 (coupled to pump motor 500 in back of base 200), also shown on the front face of base 200. Safety manifold cartridge 505 is shown attached to base 200 via clip 506.

It can clearly be seen with reference to FIG. 5A, that actuating means 503 is in an open position, FIG. 5B depicts the same components described hereinabove with reference to FIG. 5*a;* however, it can clearly be seen with reference to FIG. 5B, that actuating means 503 is in a closed position and that the depicted knob has been rotated to change the position of the pump shoe.

Assuming actuating means 503 has been fabricated in accordance with the teachings of the invention as set forth hereinabove, the pump depicted in FIGS. 5A–5B will automatically compensate for the manufacturing tolerances of the tube introduced as part of the safety manifold cartridge; and will function to achieve the other objective recited hereinbefore.

In addition to the apparatus described herein, those skilled in the art will readily appreciate that the present invention contemplates the use of novel methods for (a) actuating a self-adjusting pump head assembly that includes a variable position pump shoe slidably attached to a base; (b) pumping liquids through a tube introduced into a peristaltic pump; and (c) controlling a peristaltic pump used to pump liquids through a tube introduced into the pump.

An exemplary method for actuating a self-adjusting pump head assembly that includes a variable position pump shoe slidably attached to a base, where the pump head assembly is used to pump liquids through a tube introduced into a peristaltic pump that includes a rotor assembly having a rotating mandrel portion with at least one roller located on the periphery of the mandrel, includes the steps of: (a) translating rotational motion into linear motion to set the position of the pump shoe relative to the rotor assembly; and (b) automatically compensating for the manufacturing tolerances of a tube introduced into the pump by utilizing a compressive reaction force developed when the shoe is positioned to compress the tube against the at least one roller located on the periphery of the mandrel included in the rotor assembly.

These method steps (and the others set forth hereinafter) may all be accomplished utilizing the apparatus described hereinbefore.

A further example of a method for actuating a self-adjusting pump head assembly that includes a variable position pump shoe slidably attached to a base, wherein the pump head assembly is used to pump liquids through a tube introduced into a peristaltic pump that includes a rotor assembly having a rotating mandrel portion with at least one roller located on the periphery of the mandrel, includes the steps of: (a) pivotally attaching a slider crank mechanism, including a spring, to the shoe and a control for the slider crank mechanism, to thereby enable the position of the pump shoe to be changed relative to the rotor assembly by operation of the control; and (b) automatically compensating for the manufacturing tolerances of a tube introduced into the pump by utilizing the compressive reaction force developed by the spring when the shoe is positioned to compress the tube against the at least one roller located on the periphery of the mandrel included in said rotor assembly.

An exemplary method for pumping liquids through a tube introduced into a peristaltic pump, wherein the peristaltic pump includes a rotor assembly having a rotating mandrel portion with at least one roller located on the periphery of the mandrel, includes the steps of: (a) slidably attaching a self-adjusting pump head, including a variable position pump shoe, to a base; (b) positioning the variable position pump shoe such that in a first position a tube may to be inserted into the pump, and in a second position the tube is compressed between the pump shoe and the at least one roller located on the periphery of the mandrel, wherein the step of positioning is performed by pivotally attaching a slider crank mechanism, including a spring, to the shoe and a control for the slider crank mechanism, to thereby enable the position of the pump shoe to be changed relative to the rotor assembly by operation of the control; (c) locking the variable position pump shoe in the second position; and (d) applying a continuous reaction force on the shoe to automatically compensate for the manufacturing tolerances of the tube when the shoe is locked in the second position.

Finally, an exemplary method for controlling a peristaltic pump used to pump liquids through a tube introduced into the pump, wherein the peristaltic pump includes a rotor assembly having a rotating mandrel portion with at least one roller located on the periphery of the mandrel, and a self-adjusting pump head assembly including a variable position pump shoe slidably attached to a base, includes the steps of: (a) positioning the variable position pump shoe such that in a first position a tube may to be inserted into the pump, and in a second position the tube is compressed between the pump shoe and the at least one roller located on the periphery of the mandrel; (b) locking the variable position pump shoe in the second position utilizing pivotable slider crank means that includes a linkage or pair of links carrying a helical compression spring; and (c) automatically applying a continuous reaction force on the variable position pump shoe whenever the shoe is locked in the second position, to thereby automatically compensate for the manufacturing tolerances of a tube introduced into the pump.

What has been described in detail hereinabove are methods and apparatus meeting all of the aforestated objectives. As previously indicated, those skilled in the art will recognize that the foregoing description has been presented for the sake of illustration and description only. It is not intended to be exhaustive or to limit the invention to the precise form disclosed, and obviously many modifications and variations are possible in light of the above teaching.

The embodiments and examples set forth herein were presented in order to best explain the principles of the instant invention and its practical application to thereby enable others skilled in the art to best utilize the instant invention in various embodiments and with various modifications as are suited to the particular use contemplated.

It is, therefore, to be understood that the claims appended hereto are intended to cover all such modifications and variations which fall within the true scope and spirit of the invention.

What is claimed is:

1. Actuating means for a self-adjusting pump head assembly including a variable position pump shoe slidably attached to a base, wherein said assembly is used to pump liquids through a tube introduced into a peristaltic pump, comprising:

(a) means for translating rotational motion into linear motion located for movement relative to the base and wherein said means for translating rotational motion into linear motion further comprises a knob; and (b) cranking means located for movement relative to the base, including means for automatically compensating for the manufacturing tolerances of a tube introduced into said pump, said means for automatically compensating located for movement relative to the base and comprising a linkage and a spring pivotally attached to both said means for translating and said shoe.

2. Apparatus as set forth in claim 1 wherein said means for automatically compensating further comprises a pair of links, carrying a helical compression spring, pivotally anchored to both said means for translating and said shoe.

3. Apparatus as set forth in claim 2 wherein said pair of links further comprises a first spring plate and a second spring plate, each having an elongated slot located on a first plate end, and each having a spring retaining cross member located adjacent to each slot.

4. Apparatus as set forth in claim 1 wherein said means for translating further comprises an actuating knob.

5. A peristaltic pump for pumping liquids through a tube introduced thereto, wherein said peristaltic pump includes a rotor assembly having a rotating mandrel portion with at least one roller located on the periphery of the mandrel, comprising:

(a) a self-adjusting pump head including a variable position pump shoe slidably attached to a base; and (b) a control for positioning, locking and applying a continuous reaction force on said shoe to compress said tube between said shoe and said plurality of rollers, wherein said control further comprises means for translating rotational motion into linear motion, and cranking means, including means for automatically compensating for the manufacturing tolerances of a tube introduced into said pump, pivotally attached to both said means for translating and said shoe.

6. Apparatus as set forth in claim 5 further comprising a manifold safety cartridge, removably attached to said base, to which the ends of said tube are attached to form a U-shaped tube having a predetermined fixed length.

7. Apparatus as set forth in claim 6 wherein said manifold safety cartridge further comprises an asymmetrical tie bar preformed to prevent incorrect cartridge installation.

8. Apparatus as set forth in claim 6 wherein said manifold safety cartridge is disposable.

9. A control for a peristaltic pump used to pump liquids through a tube introduced into the pump, wherein said peristaltic pump includes a rotor assembly having a rotating mandrel portion with at least one roller located on the periphery of the mandrel, and a self-adjusting pump head assembly including a variable position pump shoe slidably attached to a base, comprising:

(a) means for positioning said variable position pump shoe such that in a first position a tube may be inserted into said pump, and in a second position said tube is compressed between said pump shoe and said at least one roller located on the periphery of said mandrel; and (b) pivotable slider crank means, for locking said variable position pump shoe in said second position and for automatically applying a continuous reaction force on said variable position pump shoe whenever said shoe is locked in said second position to thereby automatically compensate for the manufacturing tolerances of a tube introduced into said pump.

10. Apparatus as set forth in claim 9 wherein said means for positioning further comprises means for translating rotational motion into linear motion.

11. Apparatus as set forth in claim 10 wherein said pivotable slider crank means is pivotally attached to both said means for translating and said shoe.

12. Apparatus as set forth in claim 11 wherein said pivotable slider crank means further comprises a pair of links carrying a helical compression spring.

13. Apparatus as set forth in claim 10 wherein said means for translating further comprises an actuating knob.

14. A method for actuating a self-adjusting pump head assembly that includes a variable position pump shoe slidably attached with a slider crank mechanism to a base, wherein said pump head assembly is used to pump liquids through a tube introduced into a peristaltic pump that includes a rotor assembly having a rotating mandrel portion with at least one roller located on the periphery of the mandrel, comprising the steps of:

(a) translating rotational motion into linear motion to set the position of said pump shoe relative to said rotor assembly;

(b) automatically compensating for the manufacturing tolerances of a tube introduced into said pump; and (c) utilizing a compressive reaction force developed by a spring on the slider crank mechanism and attached to the shoe when said shoe is positioned to compress said tube against said at least one roller located on the periphery of the mandrel included in said rotor assembly and wherein said slider crank mechanism further comprises a linkage and said spring so said that shoe is urged by said spring against said tube.

15. A method for actuating a self-adjusting pump head assembly that includes a variable position pump shoe slidably attached by a slider crank mechanism to a base, wherein said pump head assembly is used to pump liquids through a tube introduced into a peristaltic pump that includes a rotor assembly having a rotating mandrel portion with at least one roller located on the periphery of the mandrel, comprising the steps of:

(a) pivotally attaching a slider crank mechanism, including a spring on the slider crank mechanism, to said shoe and a control for said slider crank mechanism, to thereby enable the position of said pump shoe to be changed relative to said rotor assembly by operation of said control; and (b) automatically compensating for the manufacturing tolerances of a tube introduced into said pump;

(c) utilizing the compressive reaction force developed by said spring when said shoe is positioned to compress said tube against said at least one roller located on the periphery of the mandrel included in said rotor assembly and wherein said slider crank mechanism further comprises a linkage and said spring so said shoe is urged by said spring against said tube.

16. A method as set forth in claim 15 wherein said slider crank mechanism further comprises a pair of links carrying a helical compression spring.

17. A method for pumping liquids through a tube introduced into a peristaltic pump, wherein said peristaltic pump includes a rotor assembly having a rotating mandrel portion with at least one roller located on the periphery of the mandrel, comprising the steps of:

(a) slidably attaching a self-adjusting pump head, including a variable position pump shoe, to a base;

(b) positioning said variable position pump shoe such that in a first position a tube may to be inserted into said pump, and in a second position said tube is compressed between said pump shoe and said at least one roller located on the periphery of said mandrel, wherein said step of positioning is performed by pivotally attaching a slider crank mechanism, including a spring, to said shoe and a control or said slider crank mechanism, to thereby enable the position of said pump shoe to be changed relative to said rotor assembly by operation of said control;

(c) locking said variable position pump shoe in said second position; and (d) applying a continuous reaction force on said shoe to automatically compensate for the manufacturing tolerances of said tube when said shoe is locked in said second position.

18. A method as set forth in claim 17 wherein said step of positioning further comprises the step of translating rotational motion applied to said control into linear motion for said shoe to set the position of said pump shoe relative to said rotor assembly.

19. A method as set forth in claim 17 wherein said step of locking further comprises the step of pivoting said slider crank mechanism so that said spring forward biases said pump shoe toward said rotor assembly.

20. A method as set forth in claim 17 wherein said slider crank mechanism further comprises a pair of links carrying a helical compression spring.

21. A method for controlling a peristaltic pump used to pump liquids through a tube introduced into the pump, wherein said peristaltic pump includes a rotor assembly having a rotating mandrel portion with at least one roller located on the periphery of the mandrel, and a self-adjusting pump head assembly including a variable position pump shoe slidably attached to a base, comprising the steps of:

(a) positioning said variable position pump shoe such that in a first position a tube may to be inserted into said pump, and in a second position said tube is compressed between said pump shoe and said at least one roller located on the periphery of said mandrel; and (b) locking said variable position pump shoe in said second position utilizing pivotable slider crank means that include a pair of links carrying a helical compression spring; and (c) automatically applying a continuous reaction force on said variable position pump shoe whenever said shoe is locked in said second position, to thereby automatically compensate for the manufacturing tolerances of a tube introduced into said pump.

* * * * *